US005097258A

United States Patent [19]

Iwaki

[11] Patent Number: 5,097,258

[45] Date of Patent: Mar. 17, 1992

[54] MULTICOLOR DISPLAY LAMP

[75] Inventor: Akihiro Iwaki, Ichichara, Japan

[73] Assignee: Stanley Electric Co., Ltd., Tokyo, Japan

[21] Appl. No.: 427,027

[22] Filed: Oct. 25, 1989

[51] Int. Cl.[5] ..... G08B 5/36

[52] U.S. Cl. ..... 340/815.1; 340/815.07; 362/231; 362/235; 362/292; 359/742

[58] Field of Search ..... 340/701, 702, 815.1, 340/815.15, 815.07, 762, 782; 362/235, 292, 330, 332, 331, 240, 244, 268, 800, 231; 350/452, 483; 353/38

[56] References Cited

U.S. PATENT DOCUMENTS

| | | | |
|---|---|---|---|
| 2,673,923 | 3/1954 | Williams | 362/231 |
| 3,868,501 | 2/1975 | Barbour | 362/231 |
| 4,118,114 | 10/1978 | Anderson et al. | 353/38 |
| 4,542,449 | 9/1985 | Whitehead | 362/331 |
| 4,622,881 | 11/1986 | Rand | 340/701 |
| 4,662,737 | 5/1987 | Ueguri | 340/701 |
| 4,723,119 | 2/1988 | Morimoto | 340/815.10 |

FOREIGN PATENT DOCUMENTS

| | | | |
|---|---|---|---|
| 60-232501 | 11/1985 | Japan | 350/452 |
| 2207523 | 2/1989 | United Kingdom | 350/452 |

*Primary Examiner*—Alvin E. Oberley
*Assistant Examiner*—Darin Miller
*Attorney, Agent, or Firm*—Frishauf, Holtz, Goodman & Woodward

[57] ABSTRACT

A multicolor display lamp used as a display element of a dot-matrix display device. comprises light sources having different emitting colors arranged in four areas of a square case so that their optical axes are parallel to each other, and an optical system arranged frontwardly thereof so as to individually extend emitting rays of the light source.

11 Claims, 2 Drawing Sheets

MULTICOLOR DISPLAY LAMP

BACKGROUND OF THE INVENTION (1) Field of the Invention

The present invention relates to a multicolor display lamp which is used as a display element of a dot-matrix display device.

(2) Description of the Prior Art.

In such a display device, a method for varying display colors is used as one means for diversifying the displayed contents.

However, when using a dot-matrix type display, two light emitting colors and a mixed color thereof are merely used, and a complicated structure is required which is relatively difficult to design in terms of construction.

SUMMARY OF THE INVENTION

It is an object of the present invention to provide a multicolor display lam which is simple in construction and which makes it possible to provide a multicolor display.

According to the present invention, light sources having difficult emitting colors are arranged in four areas obtained by dividing a square into upper and lower, and left and right portions so that their optical axes are parallel to each other, and optical systems for individually spreading emitting rays of said light sources are arranged on a display surface having a size corresponding to said square frontwardly thereof.

DETAILED DESCRIPTION OF THE PREFERRED EMBODIMENTS

Figure 1:
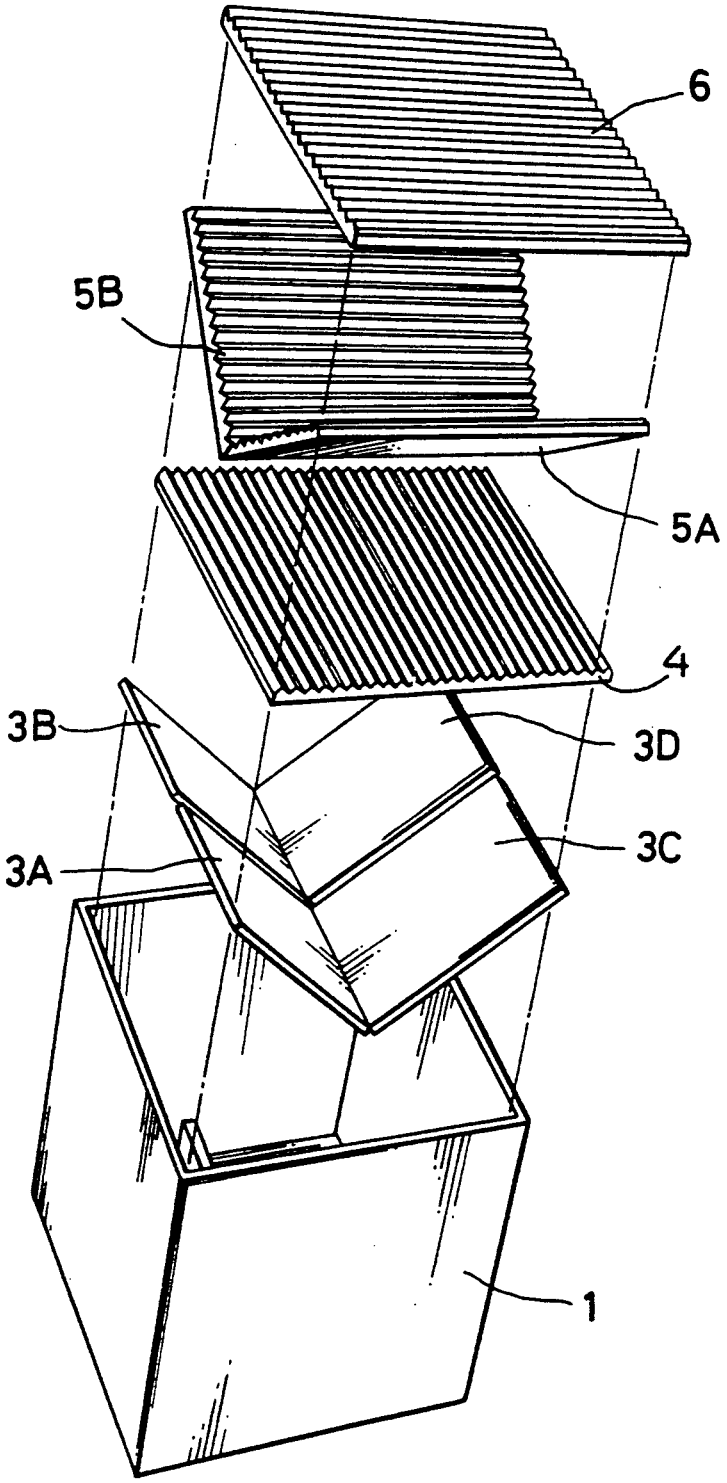
FIG. 1 is an exploded perspective view showing one embodiment of a multicolor display lamp according to the present invention.

The present invention will now be described in detail by way of the embodiment shown in the drawings.

Figure 2:
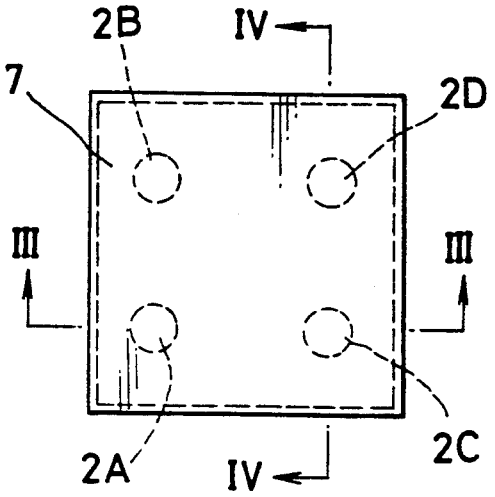
FIG. 2 is a front view thereof.
Figure 5:
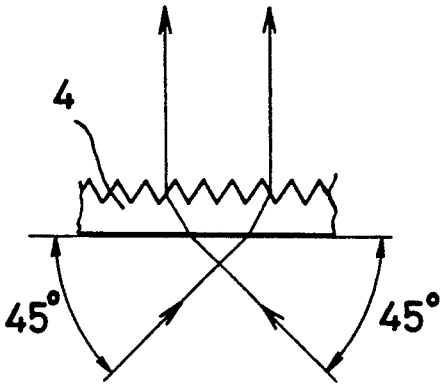
FIG. 5 is a sectional view showing a cut state of a lens in the illustrated embodiment.
Figure 3:
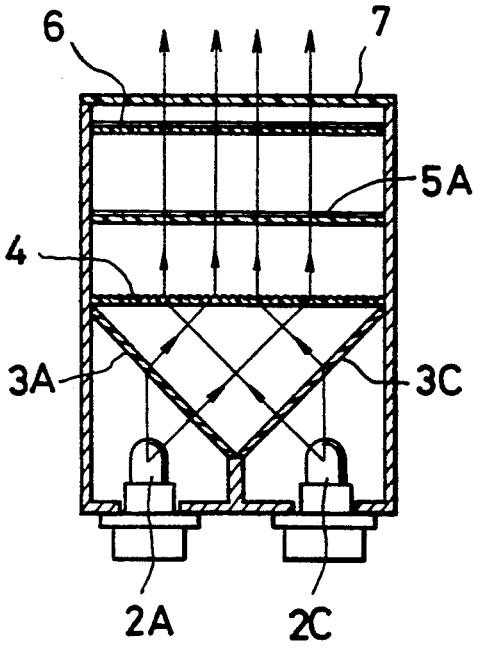
FIG. 3 is a sectional view taken on lines III—III in FIG. 2.
Figure 4:
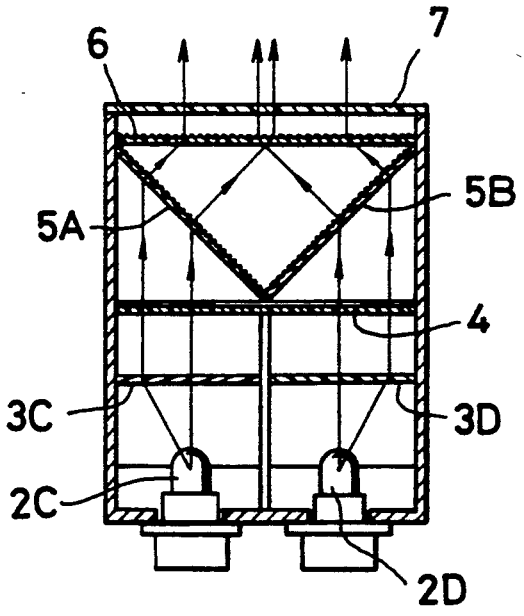
FIG. 4 is a sectional view taken on line IV—IV in FIG. 2.

FIGS. 1 to 5 show on embodiment of the present invention. Four light sources 2A, 2B, 2C and 2D each having different emitting colors arranged in deep portions of a square case 1 (see FIGS. 3 and 4) so that their optical axes are parallel to each other, and plate-like lenses 3A, 3B, 3C and 3D are arranged so as to be inclined on front surfaces thereof. In this case, the aforesaid inclination is such that V-shapes are formed by the lenses 3A and 3C, and 3B and 3D, respectively.

A plate-like lens 4 perpendicularly intersecting with an optical axis is arranged in front of the front surface of the lenses 3A to 3D. Plate-like lenses 5A and 5B are arranged so as to be inclined by 45° in front of the front surface of lens 4. In this case, the aforementioned inclination of lenses 5A and 5B is such that a V-shape is formed by the lenses 5A and 5B, and a line of a root thereof is at a right angle to a line of a root of the V-shapes formed by the lenses 3A to 3D. A plate-like lens 6 is arranged so as to be perpendicularly intersecting with the optical axis and in front of the front surface of the lenses 5A and 5B, that is, parallel to the lens 4. Lens 6 is positioned in the vicinity of an opening in the front surface of the case 1, and an appearance and protective plate 7 (see FIGS. 3 and 4) is mounted on the front opening of the case 1.

The aforementioned lenses comprise a Fresnel lens with a desired cut (see FIG. 5) applied thereto.

With the arrangement as described above, when the emitting rays of the light sources 2A and 2D pass through the lenses, they spread in both longitudinal and lateral directions and are formed into parallel rays, which extend over the display surface 7, that is, over the whole surface of the appearance and protective plate 7. Accordingly, a multicolor display is effected by the four emitting colors of the light sources 2A–2D and mixed colors thereof, and a diversified display can thus be made by a dot-matrix display which comprises a plurality of the display lamps described above.

If the lenses 3A to 3D comprise colored lenses with respective different colors, even if all of four light sources 2A–2D are in white in color, an effect similar to that described above can be obtained. A similar effect can also be obtained by the provision of filters with different colors between the lens 4 and the light sources 2A–2D. As a light source, an incandescent bulb or other light emitting diode with different emitting colors can also be used. In the case where light emitting diodes with different emitting colors are used, the aforesaid lenses are to be transparent.

As described above, according to the present invention, four light sources with different emitting colors are arranged so that their axes are parallel to each other, and an optical system is arranged frontwardly thereof to spread individual rays in both longitudinal and lateral directions and to extend them as parallel rays over the whole surface of the display surface. Therefore, a multicolor display by the emitting colors and mixed colors thereof can be effected, and when the display elements are arranged in the form of a dot-matrix display, diversified displays can be made. Since colors can be mixed in one and the same emitting surface (i.e., surface 7), the device exhibits a feature that, even if viewed from a short distance, unevenness in color is less than in the prior art.

What is claimed is:

1. A multicolor display lamp comprising:

a plurality of light sources having different emitting colors arranged in four areas obtained by dividing a rectangle into upper and lower, left and right portions;

said light sources being arranged such that their optical axes are parallel to each other; and an optical system arranged frontwardly of said light sources for individually spreading emitting rays of said light sources in both longitudinal and lateral directions to form parallel rays which extend over a whole of a display surface which has a size corresponding to an opening of said rectangle, said optical system comprising:

at least two first plate-like lenses, arranged so as to be inclined relative to each other to form a generally V-shaped configuration frontward of said light sources, for bending individual rays which enter one of said first plate-like lenses non-perpendicular to the incline of said one first plate-like lens to exit perpendicular to the incline of said one first plate-like lens, and for allowing individual rays which enter one of said first plate-like lenses perpendicular to the incline of said first plate-like lens to exit perpendicular to the incline of said first plate-like lens;

a second plate-like lens, arranged perpendicular to the optical axes of said light source and frontward of said at least two first plate-like lenses, for bending individual rays which enter said second plate-like lens non-perpendicular to said second plate-like lens to exit perpendicular to said second plate-like lens and for allowing individual rays which enter said second plate-like lens perpendicular to said second plate-like lens to exit perpendicular to said second plate-like lens;

at least two third plate-like lenses, arranged so as to be inclined relative to each other to form a generally V-shaped configuration frontward of said second plate like lens and having a trough perpendicular to a trough of said generally V-shaped configuration of said at least two first plate-like lenses, for bending individual rays which enter one of said third plate-like lenses non-perpendicular to the incline of said one third plate-like lens to exit perpendicular to the incline of said one third plate-like lens, and for allowing individual rays which enter one of said third plate-like lenses perpendicular to the incline of said one third plate-like lens to exit perpendicular to the incline of said one third plate-like lens; and a fourth plate-like lens, arranged perpendicular to the optical axes of said light sources and frontward of said third plate-like lenses, for bending individual rays which enter said fourth plate-like lens non-perpendicular to said fourth plate-like lens to exit perpendicular to said fourth plate-like lens and for allowing individual rays which enter said fourth plate-like lens perpendicular to said fourth plate-like lens to exit perpendicular to said fourth plate-like lens.

2. The multicolor display lamp of claim 1, wherein said lenses comprise Fresnel lenses.

3. The multicolor display lamp of claim 1, wherein said light sources each comprise an incandescent bulb.

4. The multicolor display lamp of claim 1, wherein said light sources each comprise a light emitting diode.

5. The multicolor display lamp of claim 1, wherein said second and fourth plate-like lenses are substantially parallel to each other.

6. The multicolor display lamp of claim 1, further comprising an appearance and protective plate mounted in front of said fourth plate-like lens.

7. The multicolored display lamp of claim 1, comprising four of said light sources having different emitting colors and arranged in said respective four areas; and wherein said first plate-like lenses comprise four plate-like lenses arranged in two pairs of V-shaped lens arrangements with each of said first lenses arranged in front of a respective one of said light sources.

8. The multicolored display lamp of claim 1, further comprising a generally rectangular casing divided into said four areas, said casing having a predetermined depth; said light sources being at the bottom most portion of said casing and said first, second, third and fourth lenses being arranged within said casing in the order mentioned; and wherein said casing has an opening remote from said bottom most portion where said light sources are arranged, said fourth plate-like lens being mounted in the vicinity of said opening of said casing.

9. The multicolored display lamp of claim 8, further comprising an appearance and protective plate mounted over said front opening of said casing.

10. The multicolored display lamp of claim 9, wherein said lenses comprise Fresnel lenses having a predetermined cut applied thereto, the cut of said second lens being substantially perpendicular to the cut of said fourth lens.

11. The multicolored display lamp of claim 1, wherein said lenses comprise Fresnel lenses having a predetermined cut applied thereto, the cut of said second lens being substantially perpendicular to the cut of said fourth lens.

* * * * *